US008418412B2

(12) United States Patent
Cheng

(10) Patent No.: US 8,418,412 B2
(45) Date of Patent: Apr. 16, 2013

(54) EXPLOSION-PROOF DECOMPRESSION PLATE

(75) Inventor: Mao-Nan Cheng, Fongyuan (TW)

(73) Assignee: San Ford Machinery Co., Ltd., Fong Yuan (TW)

( * ) Notice: Subject to any disclaimer, the term of this patent is extended or adjusted under 35 U.S.C. 154(b) by 452 days.

(21) Appl. No.: 12/405,995

(22) Filed: Mar. 17, 2009

(65) Prior Publication Data

US 2010/0236153 A1 Sep. 23, 2010

(51) Int. Cl.
*E04H 9/00* (2006.01)
*E04B 1/00* (2006.01)

(52) U.S. Cl.
USPC ..... 52/100; 52/1; 52/98

(58) Field of Classification Search ..... 52/1, 98, 52/100; 220/89.2; 137/68.27
See application file for complete search history.

(56) References Cited

U.S. PATENT DOCUMENTS

| | | | | | |
|---|---|---|---|---|---|
| 3,775,915 | A | * | 12/1973 | Chambers et al. | 52/1 |
| 4,027,436 | A | * | 6/1977 | Daly | 52/1 |
| 4,821,909 | A | * | 4/1989 | Hibler et al. | 220/203.08 |
| 5,036,632 | A | * | 8/1991 | Short, III et al. | 52/1 |
| 5,100,095 | A | * | 3/1992 | Haan et al. | 248/549 |
| 5,368,180 | A | * | 11/1994 | Farwell et al. | 220/89.2 |
| D373,984 | S | * | 9/1996 | Darien | D12/400 |
| 6,070,365 | A | * | 6/2000 | Leonard | 52/1 |
| 6,390,436 | B2 | * | 5/2002 | Barnes et al. | 248/548 |
| 6,796,210 | B2 | * | 9/2004 | Baron | 83/676 |
| 6,959,828 | B2 | * | 11/2005 | Eijkelenberg et al. | 220/89.2 |
| 7,234,278 | B2 | * | 6/2007 | Eijkelenberg et al. | 52/99 |
| 7,628,167 | B2 | * | 12/2009 | Eijkelenberg et al. | 137/68.23 |
| 7,950,408 | B2 | * | 5/2011 | Farwell et al. | 52/1 |
| 2010/0293870 | A1 | * | 11/2010 | Amengual Pericas | 52/98 |

FOREIGN PATENT DOCUMENTS

ES 2293860 A1 * 3/2008

* cited by examiner

*Primary Examiner* — Joshua J Michener
*Assistant Examiner* — Elizabeth A Plummer
(74) *Attorney, Agent, or Firm* — Ming Chow; Sinorica, LLC

(57) ABSTRACT

An explosion-proof decompression plate is provided outside the explosion-proof window of an architecture or equipment. A convex part that protrudes out of the window is formed in the center of the decompression plate, and a flange is formed around the convex part. Further, a confined space is formed inside the decompression plate that is opposite to the convex part. Several thru holes are formed on the flange, and a lock-joint portion of which the area is smaller than the thru hole is formed. Several joint ribs easily splitting are formed between the flange and the lock-joint portions to connect. Accordingly, when the air blast occurs in the architecture or equipment, the decompression plate is thrust away by the blast pressure caused by the air blast and an open mouth is formed to vent out the blast pressure.

2 Claims, 6 Drawing Sheets

EXPLOSION-PROOF DECOMPRESSION PLATE

BACKGROUND OF THE INVENTION

1. Field of the Invention

This invention relates to an explosion-proof decompression plate.

2. Description of the Related Art

Generally, an explosion-proof window is provided at a determined place of an architecture or equipment, and a decompression plate is fixed with several screws outside the window. A convex part that protrudes out of the window is formed in the center of the decompression plate, and thus a confined space is formed in the inside of decompression plate to increase an area of thrust surface. Thus, when air blast occurs in the space, the decompression plate bears higher pressure; blast pressure caused by the air blast thrusts the explosion-proof window and then an opening is formed to allow the blast pressure to vent, which thereby prevents the architecture, the equipment, and operators from being damaged.

However, although the confined space is used to increase the pressure received by the explosion-proof decompression plate to keep the decompression plate away from the window, when the blast pressure caused by the air blast is too weak to make the pressure received by the decompression plate larger than the locking force of each of the screws, the blast pressure cannot thrust away the decompression plate but instead vent towards another orientation, which cause an unexpected damage.

Consequently, because of the technical defects of described above, the applicant proposed the present invention, which can effectively overcome the defects described above.

SUMMARY OF THE INVENTION

An explosion-proof decompression plate according to this invention is provided, in which a convex part that protrudes outwards is formed in the center of the decompression plate and a flange is formed around the convex part. Further, a confined space is formed in the inside of decompression plate that is opposite to the convex part to increase an area of thrust surface. At least one thru hole is formed on the flange, and at least one lock-joint portion of which the area is smaller than the at least one thru hole is formed. At least one joint rib is formed between the flange and the at least one lock-joint portion. The two ends of each of the at least one joint rib are separately conjoint to the flange and the at least one lock-joint portion and the at least one joint rib easily splits when being subject to an external force. Next, a first lock hole is formed in the middle of each of the at least one lock-joint portion into which a plurality of first screws are inserted to fix the decompression plate onto a frame, and then the frame is mounted to a portion outside the explosion-proof window of the architecture or equipment. Next, two position limiting units are provided between the decompression plate and the frame. Accordingly, when the air blast occurs in the architecture or the equipment, not only the blast pressure caused by the air blast easily thrusts away the decompression plate and then vents out of the explosion-proof window, but also the decompression plate thrust by the blast pressure remains outside the explosion-proof window because of the position limiting by each of the position limiting units, which prevents nearby equipments and articles from being damaged and people from being injured.

DETAILED DESCRIPTION OF THE PREFERRED EMBODIMENTS

Now, the present invention will be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 1:
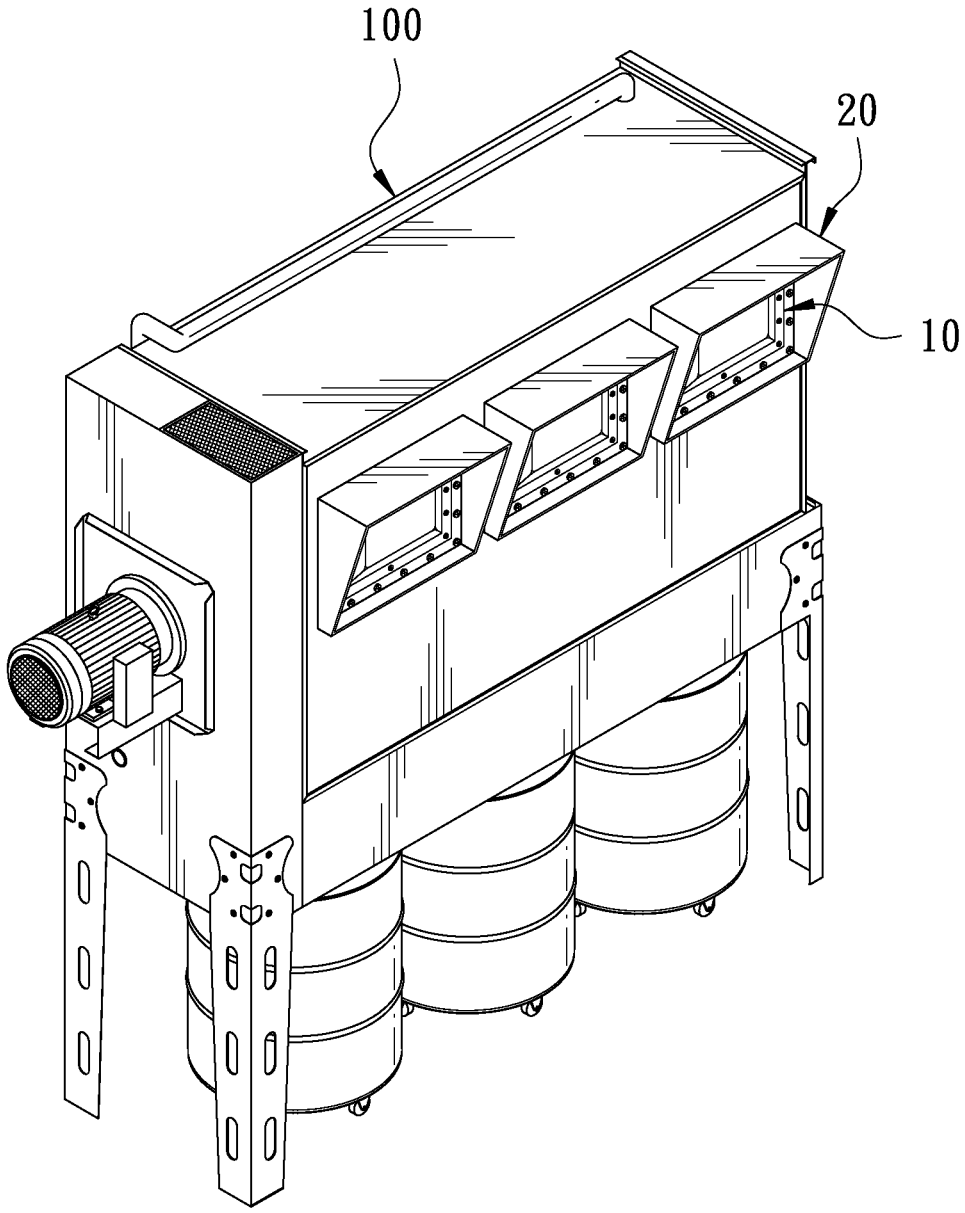
FIG. 1 is a 3D view of a carpentry-based dust collector according to this invention in preferred embodiment.
Figure 2:
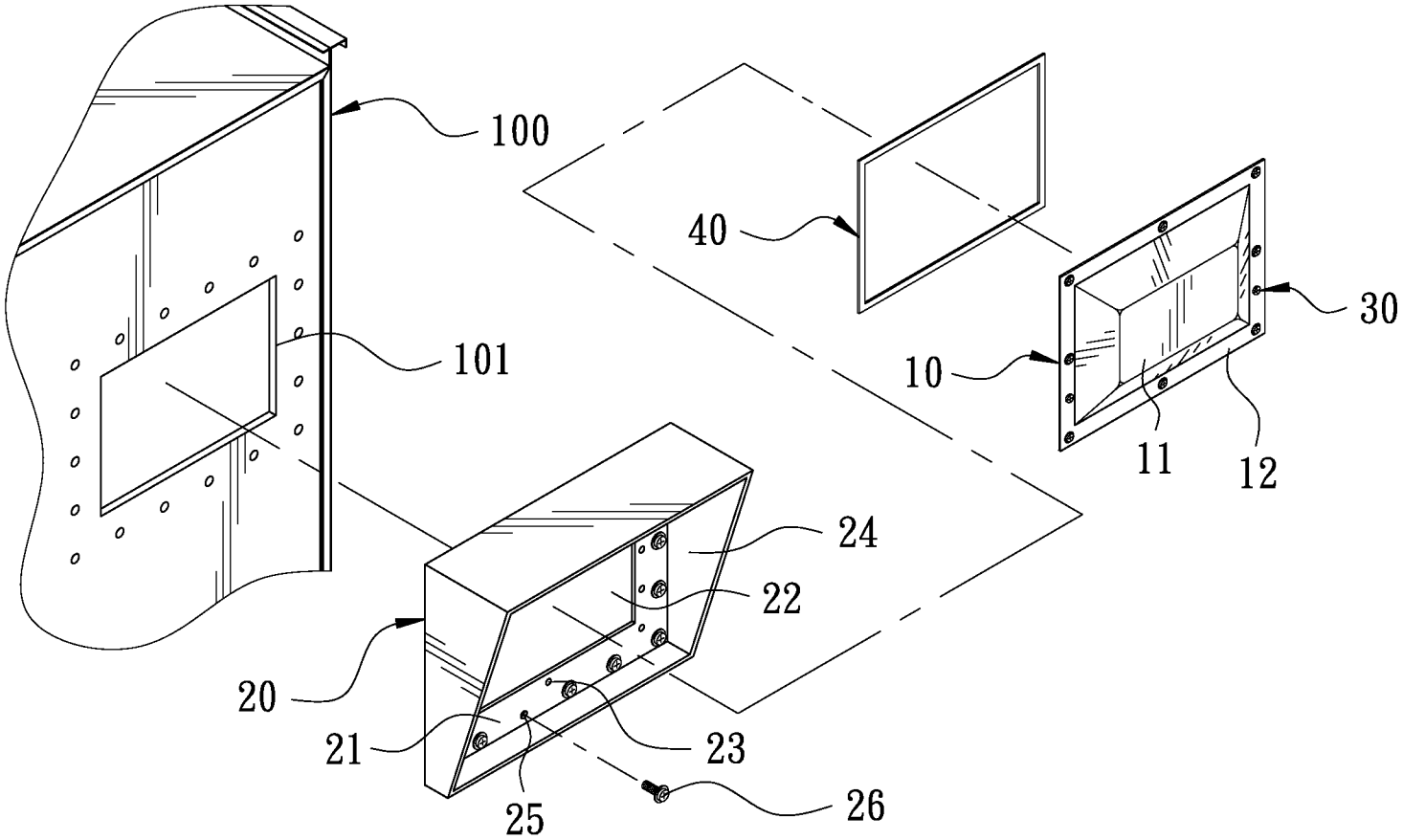
FIG. 2 is a partially enlarged and exploded 3D view of a decompression plate according to this invention in the preferred embodiment.

With reference to FIGS. 1 and 2 shown respectively as a 3D view and a partially enlarged and exploded 3D view that illustrate a carpentry-based dust collector 100 according to this invention in a preferred embodiment, owing to mote collected by the dust collector 100 that is combustible, air blast easily occurs in the carpentry-based dust collector 100 and then causes explosion during operation. Thus, three explosion-proof windows 101 that are spaced at a distance of intervals are formed outside the dust collector 100, and a decompression plate 10 is provided outside each of the explosion-proof windows 101. The decompression plate 10 is mounted onto a frame 20 and then the frame 20 is mounted onto the explosion-proof window 101. Thus, when serving outdoors, the dust collector 100 may prevent the decompression plate 10 from being corroded, after being subject to the rain; when the dust collector 100 serves indoors, a relief tube may be connected to the frame 20 to discharge the blast pressure caused by the air blast to outdoors.

Figure 3:
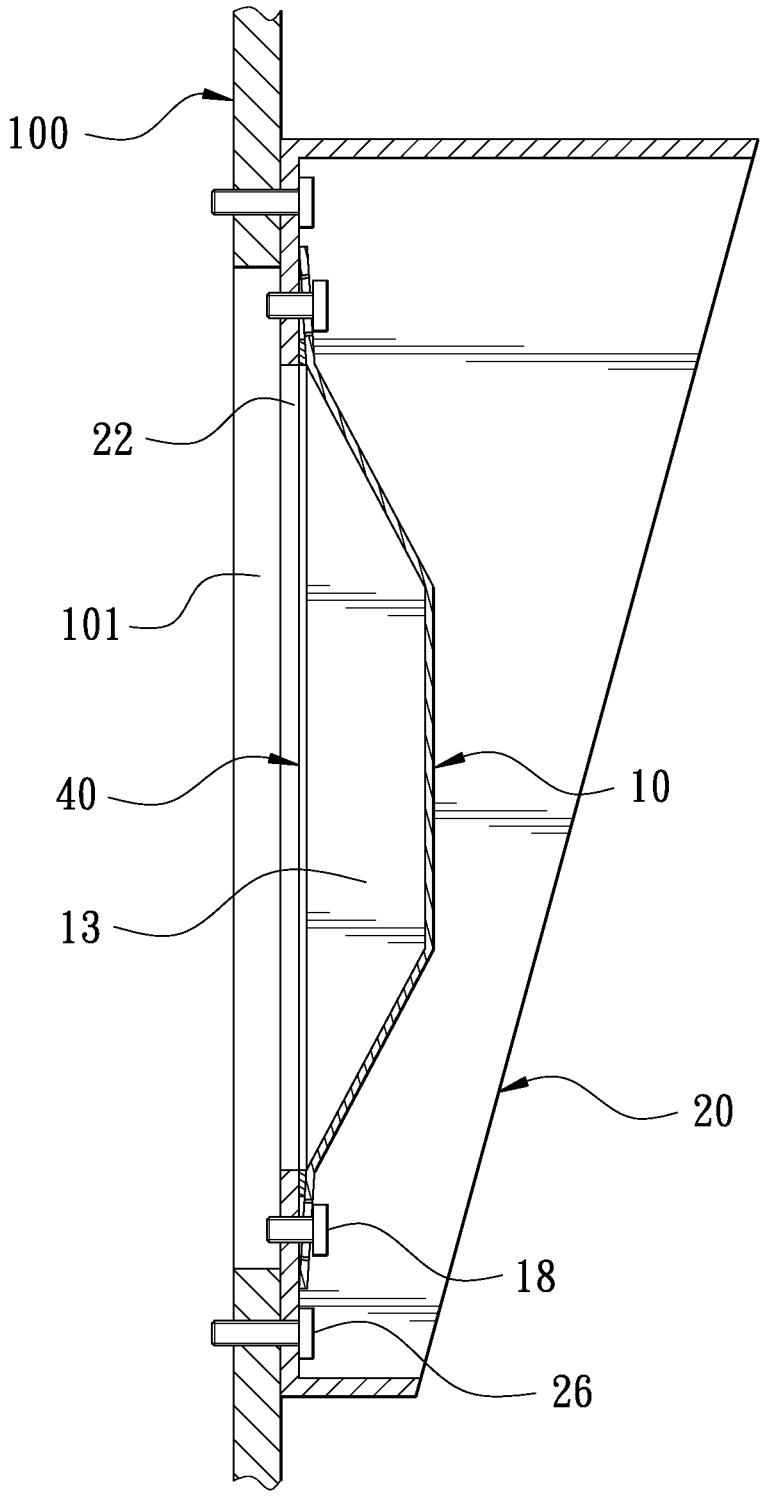
FIG. 3 is a partially enlarged and sectional view of the decompression plate according to this invention in the preferred embodiment.
Figure 4:
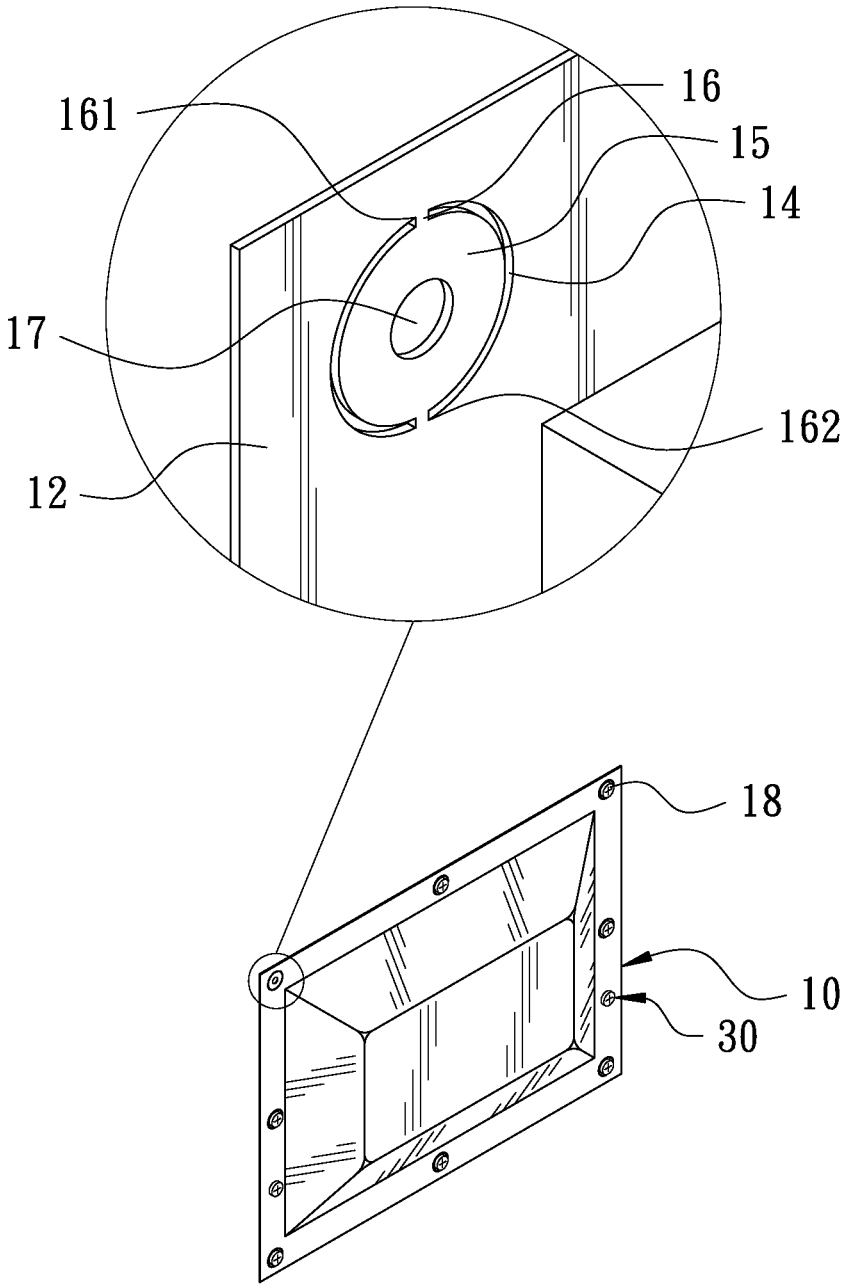
FIG. 4 is a partially enlarged 3D view of the area of a thru hole provided for the decompression plate according to this invention.

With reference to FIGS. 2, 3, and 4 shown as a partially enlarged and exploded 3D view and a sectional view of a decompression plate according to this invention in a preferred embodiment, and as a partially enlarged 3D view of a thru hole, the decompression plate 10 is normally a rectangular metallic plate of which the middle section is formed with a convex part 11 protruding out of the window, and a flange 12 is formed around the convex part 11. Then, a confined space 13 shown as that in FIG. 3 is formed in the inside of the decompression plate 10 that is opposite to the convex part 11. Further, with reference to FIG. 4, several thru holes 14 are formed on the flange 12, and a lock-joint portion 15 of which the area is smaller than the thru hole 14 is formed. Several joint ribs 16 are formed between the flange 12 and the lock-joint portion 15. The two ends of each of the joint ribs 16 are separately conjoint to the flange 12 and the lock-joint portions 15. Next, a first lock hole 17 is formed in the middle of each of the lock-joint portions 15 and one of a plurality of first screws 18 is inserted into the first lock hole 17 to fix the decompression plate 10 onto a frame 20 shown as that in FIG. 2. The frame 20 is mainly formed with a base plate 21. A open mouth 22 of which the area is smaller than the decompression plate 10 is formed passing through the center of base plate 21, and around the circumference of the open mouth 22, a second lock hole 23 opposite to the first lock hole 17 on the decompression plate 10 is formed. The circumference of the base plate 21 transversally stretches along the central axis of the open mouth 22 to form a containing space 24 where the decompression plate 10 is contained. Further, the base plate 21 is formed with several third lock holes 25 around the open mouth 22, and several second screws 26 are used to pass through the third lock holes 25 to mount the frame 20 to the outside of explosion-proof window 101. A seal ring 40 surrounding the open mouth 22 of the base plate 21 is provided between the decompression plate 10 and the frame 20 for achievement of the effect of airtight. Next, two position limiting units 30 are provided between the flange 12 of the decompression plate 10 and the base plate 21 of the frame 20.

With reference to FIG. 4 shown as a partially enlarged 3D view of a thru hole provided for the decompression plate according to this invention, when the decompression plate 10 is exerted with an external force, stress is concentrated at a cross connection 161 between the joint ribs 16 and the flange 12 and at a cross connection 162 between the joint ribs 16 and the lock-joint portion 15. Thus, even if the blast pressure caused by the air blast is weak, the pressure may still be made to effectively concentrate on the joint ribs 16 and then make the joint ribs 16 split.

Figure 5:
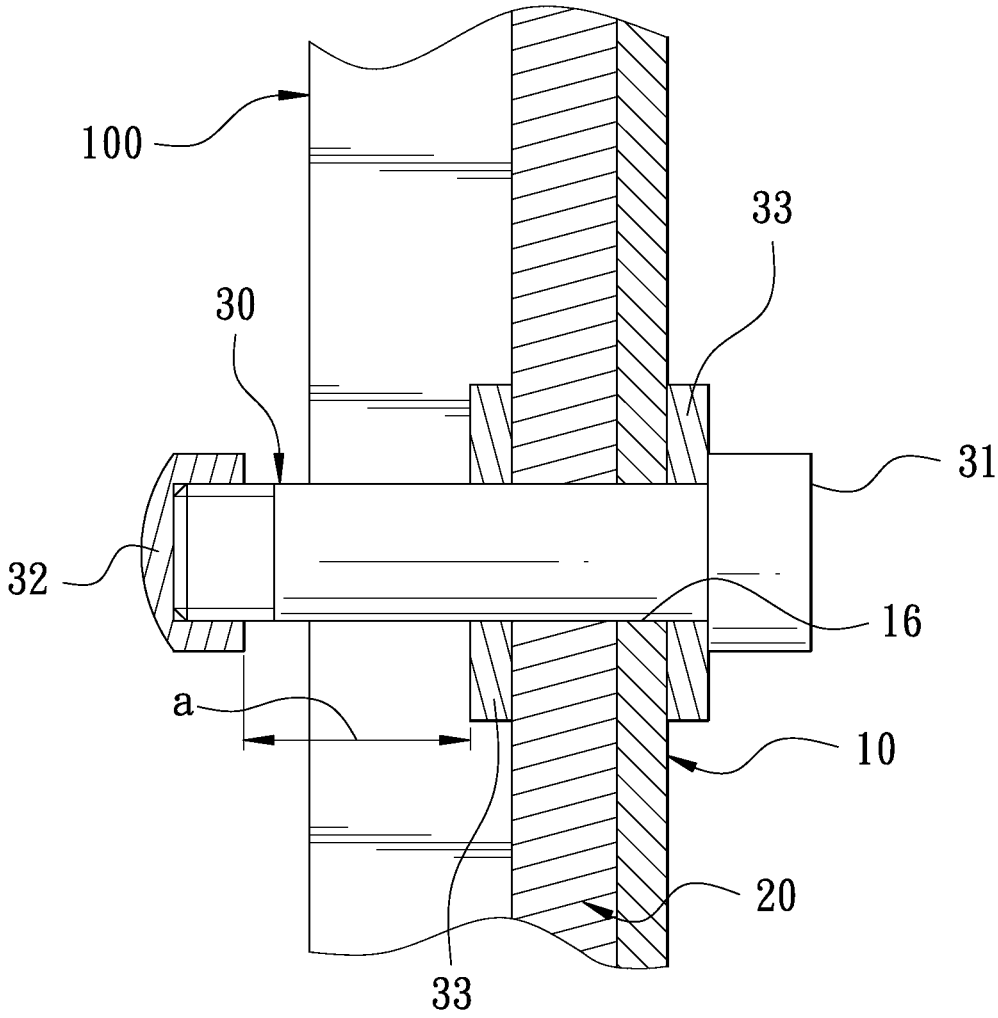
FIG. 5 is a sectional view of a position limiting provided for the decompression plate according to this invention.

With reference to FIG. 5 shown as a sectional view of a position limiting provided for the decompression plate according to this invention, each of the position limiting units 30 mainly comprises a screw bolt 31 which length is larger than the total thickness of the decompression plate 10 and frame 20. An end of the screw bolt 31 is fixed to a cap nut 32. Thus, when the decompression plate 10 is mounted onto the frame 20, a clearance (marked as 'a') is formed inside between the cap nut 32 and the frame 20 to avoid the issue of intensity design in which higher blast pressure may be applied to the decompression plate 10 to make the decompression plate 10 deviate from the frame 20. Further, gaskets 33 are provided respectively between the front end of screw bolt 31 and the outside of decompression plate 10 and between the inside of frame 20 and the cap nut 32 to increase the area of the front end of screw bolt 31 and that of cap nut 32, which prevents the position limiting units 30 from deviating from the frame 20 during operation.

Figure 6:
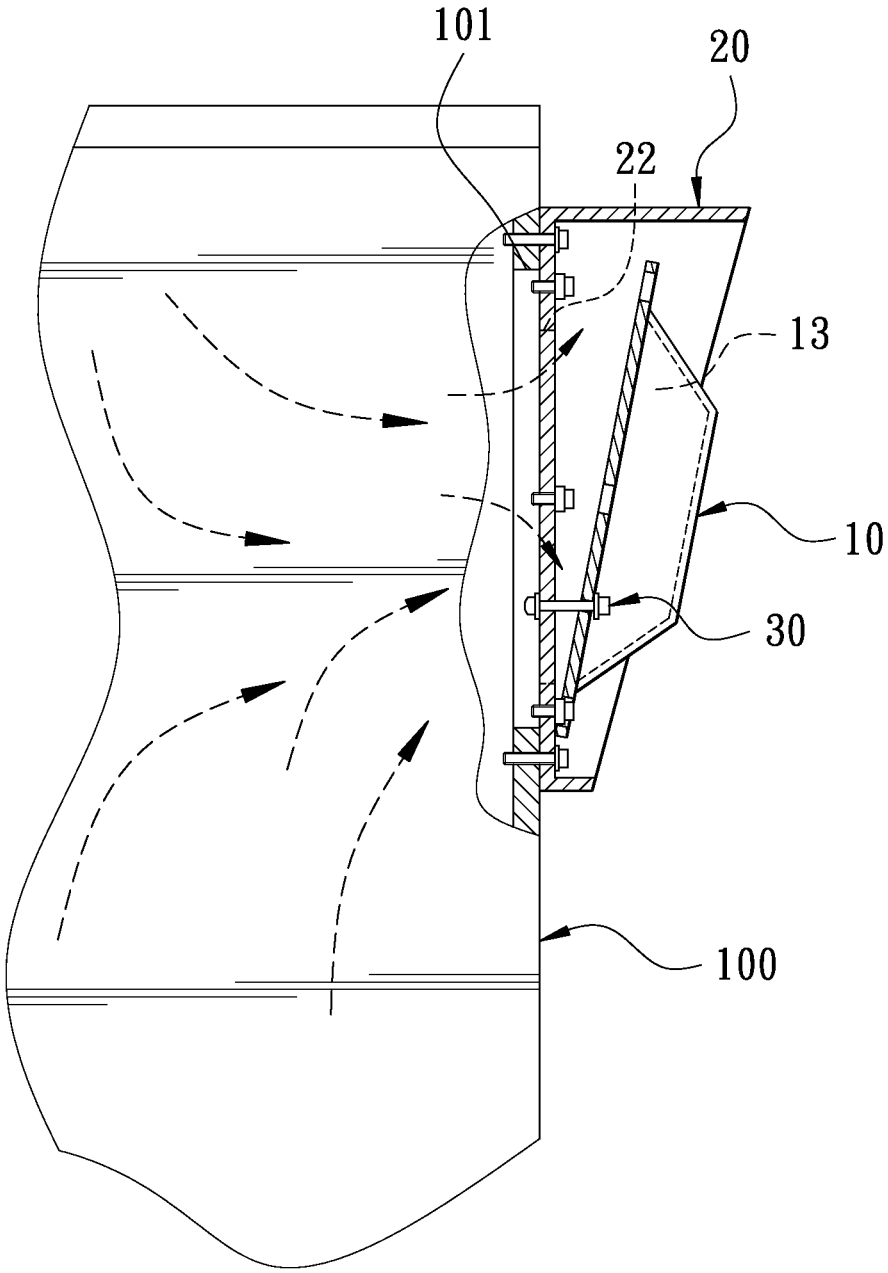
FIG. 6 is a schematic view illustrating the decompression plate according to this invention that is thrust by blast pressure to stays away from an explosion-proof window.

With reference to FIG. 6 and cross reference to FIG. 4, a schematic view illustrating the decompression plate according to this invention that is thrust by blast pressure to stay away from an explosion-proof window, when the air blast occurs, the confined space 13 on the decompression plate 10 of which the area is larger bears higher air blast and then the pressure is effectively concentrated on the joint ribs 16 shown in FIG. 4 to make them split, then the decompression plate 10 is thrust away from the frame 20 by the blast pressure to form a mouth, and because fluid flows to a low-pressure area, the blast pressure is made to vent out of the explosion-proof window 101. Besides, with the position limiting units 30, after being thrust away, the decompression plate is made to still remain outside the explosion-proof window 101, which thereby prevents nearby equipments from being damaged and people from being injured.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An explosion-proof decompression plate mounted onto a frame, comprising:

a convex part that protrudes outwards being formed in the center of the decompression plate;

a flange being formed around the convex part;

a confined space being formed inside the decompression plate that is opposite to the convex part;

at least one through hole being formed on the flange;

at least one lock-joint plate having a smaller area than the area of the at least one through hole;

at least one joint rib being formed between the flange and the at least one lock-joint plate;

the at least one joint rib having two ends, each of the two ends of the at least one joint rib being separately conjoint to the flange and the at least one lock-joint plate;

a first lock hole being formed passing through each of the least one lock-joint plate; and at least one position limiting unit connecting the decompression plate to the frame, wherein the frame comprises a base plate;

an open mouth having a smaller area than the decompression plate being formed passing through the center of the base plate;

a second lock hole opposite to the first lock hole on the decompression plate being formed around the circumference of the open mouth;

the circumference of the base plate transversally stretching along the central axis of the open mouth to form a containing space wherein the decompression plate is contained; and the base plate being formed with at least one third lock hole around the open mouth to mount the frame to the outside of an explosion-proof window of an architecture or equipment, and the at least one position limiting unit comprising a screw bolt passing through the decompression plate and the frame and having a length larger than the total thickness of the decompression plate and the frame;

a cap nut fixed to a back end of the screw bolt adjacent to the frame;

at least two gaskets respectively provided between a front end of the screw bolt and the outside of the decompression plate and between the frame and the cap nut; and a clearance being formed between the cap nut and the frame.

2. The explosion-proof decompression plate mounted onto a frame according to claim 1, wherein a seal ring surrounding the open mouth of the base plate is provided between the decompression plate and the frame.

* * * * *